United States Patent [19]

Williamson

[11] 4,344,736

[45] Aug. 17, 1982

[54] SEALING DEVICE

[75] Inventor: Willie Williamson, Shelton Lock, England

[73] Assignee: Rolls-Royce Limited, London, England

[21] Appl. No.: 198,467

[22] Filed: Oct. 20, 1980

[30] Foreign Application Priority Data

Nov. 22, 1979 [GB] United Kingdom ..... 7940380

[51] Int. Cl.[3] ..... F03B 15/00; F01B 25/00

[52] U.S. Cl. ..... 415/14; 415/131; 415/140; 277/82; 277/30

[58] Field of Search ..... 415/170 R, 171 R, 174, 415/14, 140, 131, 132, 129; 277/75, 82, 83, 30

[56] References Cited

U.S. PATENT DOCUMENTS

| | | | |
|---|---|---|---|
| 2,702,157 | 2/1955 | Stalker | 415/131 |
| 3,309,059 | 3/1967 | Braikevitch | 415/129 |
| 3,623,736 | 11/1971 | Williamson | 415/170 R |

*Primary Examiner*—Louis J. Casaregola
*Assistant Examiner*—Peter M. Cuomo
*Attorney, Agent, or Firm*—Cushman, Darby & Cushman

[57] ABSTRACT

This device is aimed at solving the problem of varying sealing gaps between a rotatable turbine disc and fixed structure. Axial movement of the turbine disc relative to the fixed casing causes a ring coaxially carried in air bearings on the turbine disc for relative rotation and movement therewith, to operate at least one lever which in turn rotates a shaft. Rotation of the shaft operates further levers to cause seal rings operatively supported thereby, to precisely follow the axial movement of the turbine disc.

6 Claims, 2 Drawing Figures

SEALING DEVICE

This invention relates to a sealing device for sealing a volume between relatively rotatable parts.

The invention is suitable for sealing inter alia a gas volume between static and rotating parts in a gas turbine engine.

The invention seeks to provide a sealing device capable of maintaining its position relative to an adjacent member, which, with the sealing device defines the volume to be sealed, regardless of the exertion of loads thereon which would normally tend to separate the sealing device from the adjacent member.

According to the present invention there is provided a sealing device comprising an annular seal member and a relatively rotatable member which cooperate to seal a gas volume, said relatively rotatable member being movable in a direction normal to the plane of rotation and including means for transmitting said movement to said annular seal member, said movement transmitting means comprising a ring located coaxially on said rotatable member for relative rotation and movable therewith in said direction normal to the plane of rotation, pivotable means and pivot links connecting said ring to said annular seal member via said pivotable means, the arrangement being such that, on said ring and rotatable member moving in a direction normal to the plane of relative rotation thereof some of said links pivot said pivoting means and the pivoting means pivots the remaining links which in turn move the annular seal member in unison with, and in the same direction as said rotatable member, to maintain the gas seal therebetween.

The pivotable means may comprise a plurality of spindles, equi-angularly spaced about the axis of rotation of said relatively rotatable member, in radial alignment therewith, the radially inner ends of said spindles being connected to those links which are pivotally connected to said ring and radially outer portions of said spindles being connected to those links which are pivotally connected to said annular seal member.

Preferably the ring is supported by said relatively rotatable member, via an anti friction device.

The anti friction device may comprise an air bearing formed by providing a pair of annular flanges on said relatively rotatable member, between which said ring is located and an annular groove in each side of said ring which with a respective flange forms an annular pocket-connectable to an air supply, for the provision of an air cushion therein.

Preferably the relatively rotatable member comprises a turbine disc for a gas turbine engine.

Preferably the turbine disc includes a coaxially formed stub shaft which includes a pair of flanges between which is located a said ring.

Figure 1:
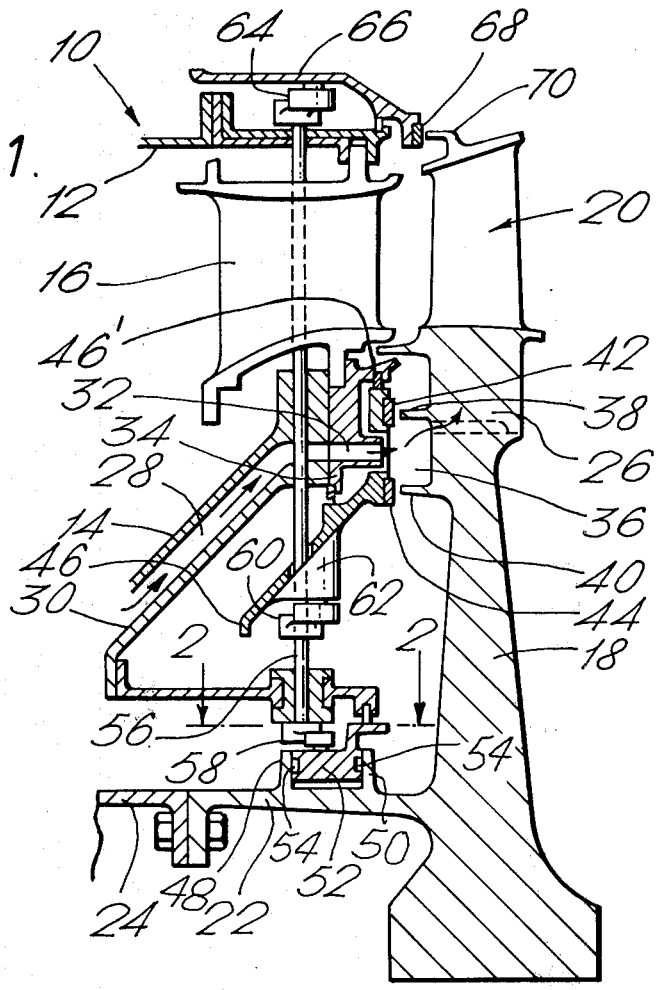
Figure 2:
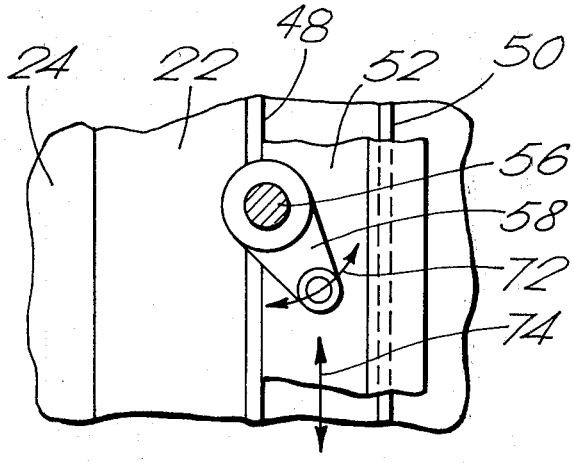

The invention will now be described by way of example and with reference to the accompanying drawings in which:

FIG. 1 is a cross-sectional part view of a gas turbine engine, incorporating an embodiment of the invention, FIG. 2 is a view on line 2—2 of FIG. 1.

Referring to FIG. 1. The downstream end of a gas turbine engine combustion casing is indicated by the numeral 10. Combustion casing 10 comprises an outer casing 12 and an inner casing 14. The outer and inner casing 12 and 14 are spanned at their downstream extremities, by a circular array of outlet nozzle guide vanes 16 of which one is shown.

A turbine assembly comprising a disc 18 and a number of blades 20 of which one is shown, is positioned immediately downstream of vanes 16. The turbine assembly is rotated by hot gases being guided by the vanes 16, onto blades 20 and in turn, rotates a compressor (not shown). Drive is transmitted to the compressor (not shown) via a stub shaft 22 on the turbine disc and a main shaft 24 which is fixed to stub shaft 22.

Cooling air is directed to the roots 26 of blades 20, via an annular channel 28 formed between inner casing 14 and a further, annular casing 30. The cooling air is ejected from nozzles 32 which are formed from fixed i.e. non-rotatable, structure 34 which supports vanes 16. The cooling air passes into an annular plenum chamber 36 formed by annular projections 38, 40 on the upstream faces of blade roots 26 and turbine disc 18 respectively and, annular seals 42, 44.

Annular seals 42, 44 are carried by a non rotatable frusto conical member 46 which is supported in structure 34 by a sealing ring 46' so that it can move axially relative to structure 34.

Stub shaft 22 has a pair of flanges 48, 50 between which a ring 52 is fitted in sliding engagement.

Air under pressure is applied to a small annular groove 54 on each side of ring 52, to provide an air bearing surface.

A number of spindles 56, preferably at least three but only one of which is shown, are equally angularly spaced around ring 52, so as to lie radially of the axis of rotation of stub shaft 22.

Each spindle 56 has a lever 58 rigidly attached thereto, the other end of each lever 58 being pivotally attached to the outer surface of ring 52. A similar lever 60, is also attached to each spindle 56 at a position adjacent the underside of frusto conical member 46. The other end of each lever 60 is pivotally connected to a boss 62, formed on the underside of frusto conical member 46.

When gas loads act on turbine blades 20, disc 18 is moved in a downstream direction i.e. to the right as viewed in FIG. 1. Ring 52 moves with disc 18 and causes levers 58 and therefore spindles 56, to pivot about the longitudinal axis of spindles 56. The motion is therefore transferred to levers 60, which in turn move frusto conical member 46 and its associated seals 42, 44 to the right as viewed in FIG. 1. It follows that the seals 42, 44 are maintained in a constant position with respect to the disc 18 and blades 20.

Spindle 56 can be extended through vane 16, for rigid connection to a further lever 64. Lever 64 is in turn pivotally connected to a further frusto conical member 66, which carries its own annular seal 68.

Seal 68 is arranged to cooperate with an annular fin 70 which is formed by individual fins on each blade 20 and, on rotation of spindle 56 as described hereinbefore, lever 64 moves frusto conical member 66 to maintain seal 68 in a constant position with respect to fin 70.

Referring to FIG. 2. When stub shaft 22 moves to right or left as viewed in the drawing, the pivoting movement of lever 58 as indicated by the arrow 72, will cause ring 52, to move through a small portion of a rotation in one or other direction, as indicated by arrow 74. The ability to move in this manner that ring 52 has, avoids the need for a pin and slot connection between lever 58 and ring 52.

I claim:

1. A sealing device comprising an annular seal member and a relatively rotatable member which cooperate to seal a gas volume, said relatively rotatable member being movable in a direction normal to the plane of rotation and including means for transmitting said movement to said annular seal member, said movement transmitting means comprising a ring located coaxially on said rotatable member for relative rotation and movable therewith in said direction normal to the plane of rotation, pivotable means and pivot links connecting said ring to said annular seal member via said pivotable means, the arrangement being such that, on said ring and rotatable member moving in a direction normal to the plane of relative rotation thereof some of said links pivot said pivoting means and the pivoting means pivots the remaining links which in turn move the annular seal member in unison with, and in the same direction as said rotatable member, to maintain the gas seal therebetween.

2. A sealing device as claimed in claim 1 wherein said pivotable means comprises a plurality of spindles, equiangularly spaced about the axis of rotation of said relatively rotatable member, in radial alignment therewith, the radially inner ends of said spindles being connected to those links which are pivotally connected to said ring and radially outer portions of said spindles being connected to those links which are pivotally connected to said annular seal member.

3. A sealing device as claimed in claim 2 wherein said ring is supported by said relatively rotatable member, via an anti friction device.

4. A sealing device as claimed in claim 3 wherein the anti friction device comprises an air bearing formed by providing a pair of annular flanges on said relatively rotatable member, between which said ring is located and an annular groove in each side of said ring which with a respective flange forms an annular pocket-connectable to an air supply, for the provision of an air cushion therein.

5. A sealing device as claimed in claim 4 wherein the relatively rotatable member comprises a turbine disc for a gas turbine engine.

6. A sealing device as claimed in claim 5 wherein said turbine disc includes a coaxially formed stub shaft which includes a pair of flanges between which is located a said ring.

* * * * *